US009622295B1

(12) United States Patent
Warner et al.

(10) Patent No.: US 9,622,295 B1
(45) Date of Patent: Apr. 11, 2017

(54) SCAN INDUCTION HEAT TREATMENT OF AN ELONGATED WORKPIECE

(75) Inventors: Jerry G. Warner, Jackson, WI (US); Michael P. Dziubek, Oak Creek, WI (US)

(73) Assignee: RADYNE CORPORATION, Milwaukee, WI (US)

( * ) Notice: Subject to any disclaimer, the term of this patent is extended or adjusted under 35 U.S.C. 154(b) by 2223 days.

(21) Appl. No.: 12/401,534

(22) Filed: Mar. 10, 2009

Related U.S. Application Data

(60) Provisional application No. 61/035,061, filed on Mar. 10, 2008.

(51) Int. Cl.

| | |
|---|---|
| ***H05B 6/22*** | (2006.01) |
| ***C21D 9/54*** | (2006.01) |
| ***C23C 8/00*** | (2006.01) |
| ***H05B 6/02*** | (2006.01) |

(52) U.S. Cl.
CPC ..... *H05B 6/02* (2013.01)

(58) Field of Classification Search
CPC ..... H05B 6/02; H05B 6/06; H05B 6/102
USPC ..... 219/659, 602, 607, 608, 618, 622, 637, 219/643, 647, 660, 672, 56, 56.22, 59.1, 219/121.25, 156, 158, 161–162; 266/113, 266/128, 129, 134, 104, 110, 46, 190, 266/223, 259; 148/156, 153, 155, 150, 148/154, 219, 519, 520, 559
See application file for complete search history.

(56) References Cited

U.S. PATENT DOCUMENTS

| | | | | |
|---|---|---|---|---|
| 2,643,325 A * | 6/1953 | Body et al. | ..... | 219/639 |
| 3,708,354 A * | 1/1973 | Rowell | ..... | 148/510 |
| 4,428,563 A * | 1/1984 | Cunningham et al. | ..... | 266/113 |
| 5,107,095 A * | 4/1992 | Derbyshire | ..... | 219/230 |
| 6,897,407 B2 * | 5/2005 | Gomez | ..... | 219/156 |

* cited by examiner

*Primary Examiner* — Dana Ross
*Assistant Examiner* — Ket D Dang
(74) *Attorney, Agent, or Firm* — Philip O. Post

(57) ABSTRACT

Apparatus and method are provided for preventing deformation along the longitudinal axis of a workpiece passing through a scan inductor when the workpiece has at least one section with a cross section larger than the cross section of the remainder of the workpiece. An upper and lower pair of opposing jaws transition between opened and closed positions as the workpiece passes through the scan inductor so that deformation is minimized as the workpiece passes through the scan induction apparatus.

6 Claims, 5 Drawing Sheets

SCAN INDUCTION HEAT TREATMENT OF AN ELONGATED WORKPIECE

CROSS-REFERENCE TO RELATED APPLICATIONS

This application claims the benefit of U.S. Provisional Application No. 61/035,061, filed Mar. 10, 2008, hereby incorporated by reference in its entirety.

FIELD OF THE INVENTION

The present invention relates to scan induction heat treatment of an elongated workpiece having at least one section with a cross sectional diameter greater than the cross sectional diameter of the remainder of the workpiece, and supporting such workpiece during the scan induction heat treatment process.

BACKGROUND OF THE INVENTION

A scan induction heat treatment process involves moving an elongated workpiece that generally has a length much larger than its cross sectional diameter through one or more scan inductors so that the workpiece can be heat treated, for example, in a quench hardening and/or tempering process. Either the entire length of the workpiece, or selected sections thereof, may be inductively heat treated. FIG. 1 is a simplified diagrammatic of a vertical scan induction process wherein the length of workpiece 90 passes through scan inductor 102. AC current is supplied to the scan inductor at terminals 102*a* and 102*b* from a suitable power source to establish the magnetic field that (flux) couples with the section of the workpiece moving through the inductor to inductively heat the workpiece. When the process includes quench hardening, the workpiece also passes through a quench dispersal apparatus, such as quench barrel 104, which has a series of quench holes 104*a* through which the quench medium (for example, water) passes to rapidly cool sections of the workpiece after they have been heated by passing through the scan inductor. In some arrangements the scan inductor and quench barrel may be incorporated into a single physical structure. The scan inductor and quench dispersal apparatus, if used, can be referred to as scan induction apparatus. A mechanical system is provided for holding the workpiece in position, and moving the workpiece through the scan inductor and quench barrel. The mechanical system may also rotate the workpiece as it moves through the scan inductor and quench barrel to achieve uniform heat treatment around the circumference of the workpiece. Therefore as diagrammatically illustrated in FIG. 1, the mechanical system typically includes an upper support element 112, with an upper center tooling element 112*a* attached to the upper support element, and a lower support element 116, with a lower center tooling element 116*a* attached to the lower support element. The lower center tooling is suitably attached to the workpiece so that rotational driver 114 can rotate the lower center tooling element and the attached workpiece as the workpiece moves linearly downward through the scan inductor. Upper support element 112 and upper center tooling element 112*a* are typically free spinning and capable of floating (sliding) in the vertical direction to account for workpiece longitudinal growth and shrinkage as the workpiece is heated and cooled. Further if the ends of the workpiece are heat treated, the upper and lower center tooling elements must be designed so as not to interfere with the heating of the ends. Linear driver 118 moves the upper and lower center tooling elements, with workpiece 90 positioned between these center tooling elements, in a vertical direction so that at least the length of the workpiece to be inductively heat treated passes through the scan inductor and quench barrel. For quench heat treatment, the linear drive will move the workpiece down through the scan inductor and quench ring with quench spray emitting from the quench holes while the workpiece is inductively heated. If tempering of the workpiece is desired after quench hardening, the linear drive can make a second pass of the workpiece through the scan inductor with no quench spray while the workpiece is inductively heated to a temperature required for tempering. In alternative designs, the workpiece may be fixed in position and the scan inductor and quench barrel may be moved over the length of the workpiece.

When the workpiece is particularly slender in cross sectional diameter relative to its length, there is a tendency for the workpiece to structurally deform, or warp, along its longitudinal axis between the time that a section of the workpiece is inductively heated by moving through the scan inductor, and quenched by moving through a quench spray emanating from the quench barrel. One example of such a workpiece is a socket wrench extension (bar) as shown in FIG. 2(*b*) that comprises a relatively slender and long metal rod, or shaft 90*b*, having a square fitting at a first end with a locking mechanism for locking a particular socket in place, and a female socket opening 90*b* at the opposing end for locking the extension bar in place on a socket wrench or another extension device. The female socket opening has an expanded cross section that is greater than the cross section of the shaft (including the square fitting at the first end of the extension bar). Deformation of a socket wrench extension during the induction heat treatment process renders the socket wrench extension unusable. Consequently subsequent to induction heat treatment, the socket wrench extension must be subjected to one or more industrial processes wherein the deformation is corrected to an acceptable tolerance.

It is one objective of the present invention to avoid such deformation of a workpiece during a scan induction heat treatment process.

SUMMARY OF THE INVENTION

In one aspect, the present invention is apparatus for, and method of, scan induction heat treatment of a workpiece having at least one section with a cross sectional diameter larger than the smaller cross sectional diameter of the remainder of the workpiece. Separate pairs of opposing jaws are situated between a scan inductor, and quench apparatus, if used. Each pair of opposing jaws has an opened and closed position. In the closed position, each pair of opposing jaws form an opening slightly larger than the smaller cross sectional diameter of the workpiece through which the smaller cross sectional diameter of the workpiece will pass. In the opened position, the at least one section of the workpiece with a larger cross sectional diameter, or a center tooling element, can pass between the opposing pair of jaws.

In another aspect, the present invention is a support apparatus for retaining an elongated workpiece during an electric induction heat treatment longitudinal scan of the elongated workpiece where the elongated workpiece has at least one expanded cross sectional feature with an expanded cross section greater than the non-expanded cross section of the remainder of the elongated workpiece. The support apparatus comprises a first and second retaining element disposed on opposing sides of a scan induction apparatus.

Each retaining element comprises a pair of opposing jaws and an actuator attached to each opposing jaw that move the pair of opposing jaws between an opened and a closed position. The closed position forms a closed elongated workpiece longitudinal passage between the pair of opposing jaws. The center of the closed elongated workpiece longitudinal passage is axially aligned with an interior passage of the scan induction apparatus. The closed elongated workpiece longitudinal passage is sized to allow longitudinal passage of the non-expanded cross section of the elongated workpiece through the closed elongated workpiece passage while retaining the elongated workpiece. The opened position forms an opened elongated workpiece longitudinal passage between the pair of opposing jaws sized to allow free longitudinal passage of the at least one expanded cross sectional feature of the elongated workpiece through the opened elongated workpiece passage. A fixturing apparatus is provided for retaining the opposing ends of the elongated workpiece and for moving the elongated workpiece through the first and second retaining elements and the scan induction apparatus.

In another aspect, the present invention is a method of controlling longitudinal deformation of an elongated workpiece during an electric induction heat treatment longitudinal scan of the elongated workpiece when the elongated workpiece has at least one expanded longitudinal cross sectional feature with an expanded cross section greater than the non-expanded cross section of the remainder of the elongated workpiece. First and second retaining elements are positioned on opposing sides of a scan induction apparatus having an interior passage for longitudinal passage of the elongated workpiece. The length of the elongated workpiece is linearly moved through the first and second retaining elements and the scan induction apparatus. The non-expanded cross section of the elongated workpiece is retained as it moves linearly through a closed position opening in the first or second retaining element where the closed position opening is sized approximately to the non-expanded cross section of the elongated workpiece. The closed position opening is opened in the first or second retaining element to allow free passage of the at least one expanded cross sectional feature of the elongated workpiece during the electric induction heat treatment longitudinal scan.

In another aspect, the present invention is a method of controlling longitudinal deformation of a socket wrench extension during an electric induction heat treatment longitudinal scan of the socket wrench extension. An entry retaining element and an exit retaining element are disposed on opposing sides of the scan induction apparatus. The entry and exit retaining elements each have an interior passage for longitudinal passage of the socket wrench extension during the electric induction heat treatment longitudinal scan. Each of the entry and exit retaining elements comprises a pair of opposing jaws and an actuator attached to each one of the opposing jaws. The length of the socket wrench extension moves sequentially through the entry retaining element, the scan induction apparatus and the exit retaining element. The entry retaining element and exit retaining element form a closed passage through which the shaft of the socket wrench extension passes. The closed passage is sized to contain the shaft cross section of the socket wrench extension. The entry or exit retaining element is opened to allow passage of the expanded cross section female socket opening end of the socket wrench extension during the electric induction heat treatment longitudinal scan.

The above and other aspects of the invention are further set forth in this specification and the appended claims.

BRIEF DESCRIPTION OF THE DRAWINGS

For the purpose of illustrating the invention, there is shown in the drawings a form which is presently preferred. It being understood, however, that this invention is not limited to the precise arrangements and instrumentalities shown.

FIG. 2(*b*) is one non-limiting example of a workpiece, namely a socket wrench extension, that can be heat treated with the scan induction heat treatment apparatus of the present invention.

DETAILED DESCRIPTION OF THE INVENTION

While the present invention will be described in connection with a preferred embodiment, it will be understood that it is not intended to limit the invention to that embodiment. On the contrary, it is intended to cover all alternatives, modifications and equivalents as may be included within the scope of the invention.

Figure 2B:
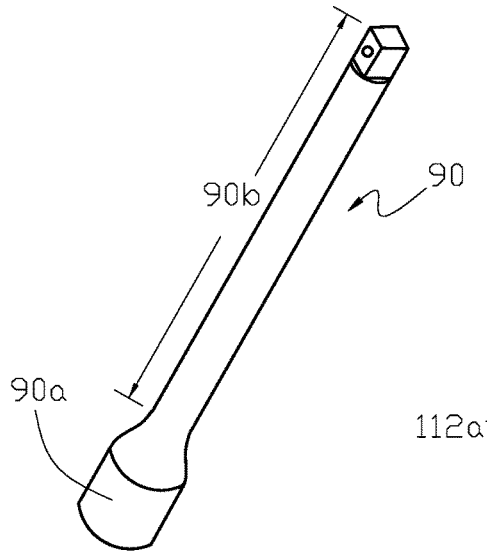
FIG. 2(*a*) is a partial perspective view of one example of a scan induction heat treatment apparatus of the present invention.
Figure 2A:
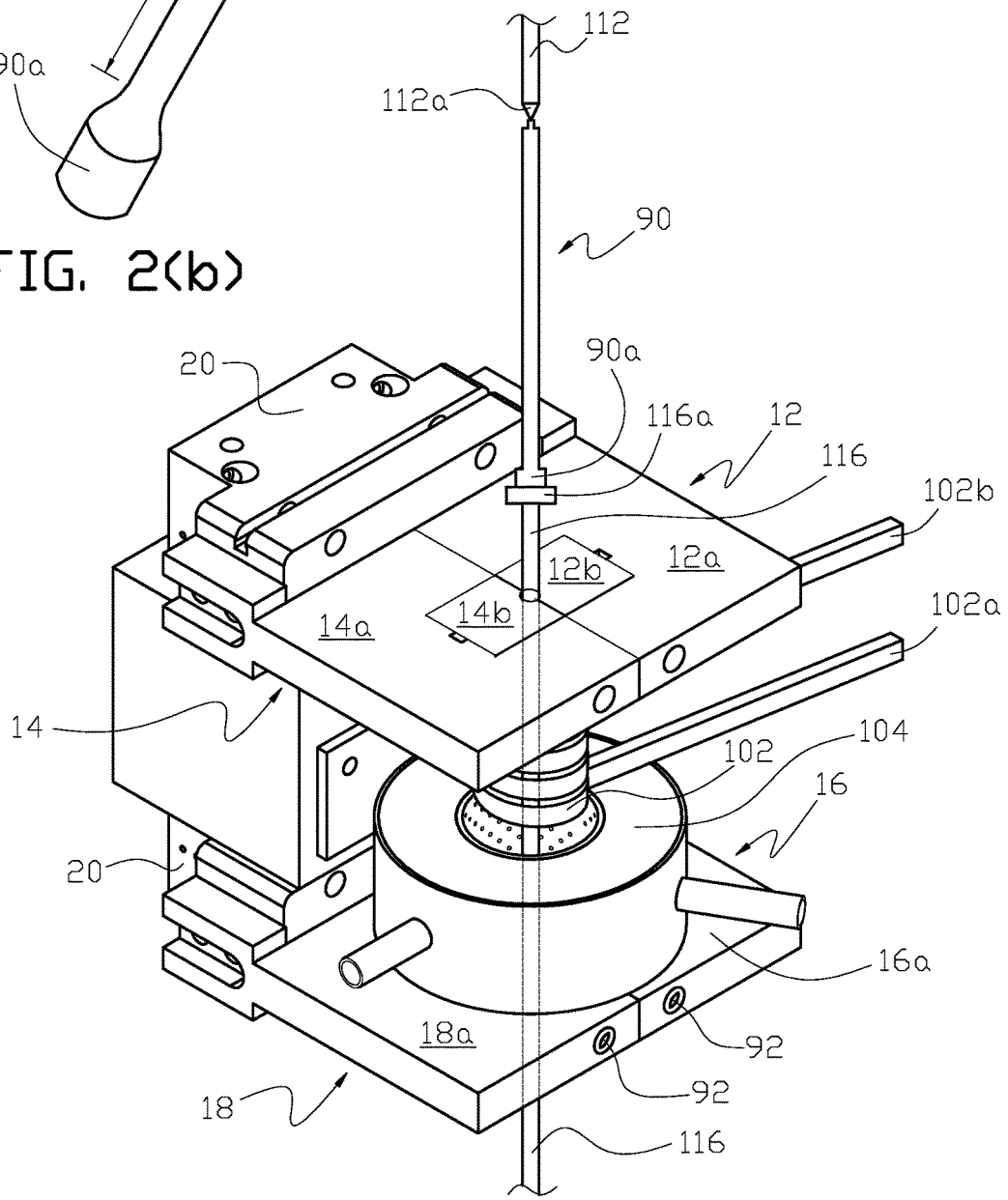
Figure 3A:
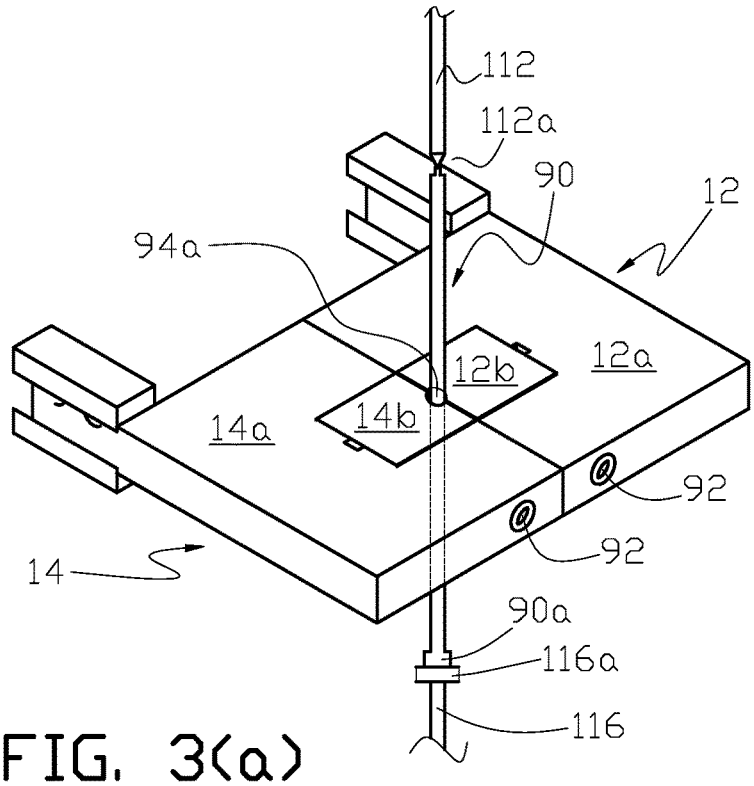
FIG. 3(*a*) and FIG. 3(*b*) are perspective views of one example of a pair of opposing jaws used with the apparatus shown in FIG. 2(*a*) shown in the closed and opened positions, respectively.
Figure 3B:
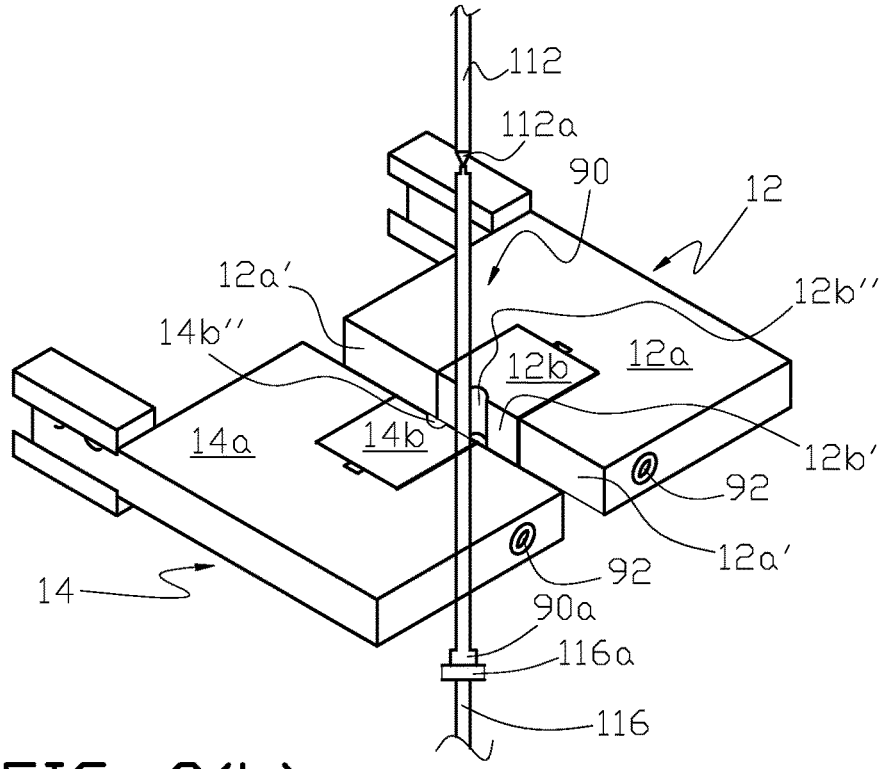
Figure 4A:
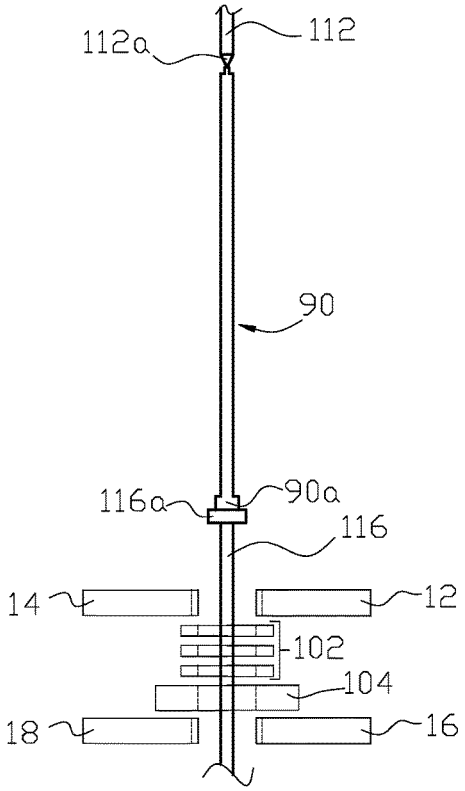
FIG. 4(*a*) through FIG. 4(*g*) illustrate one example of an induction scan heat treatment process of the present invention.
Figure 4C:
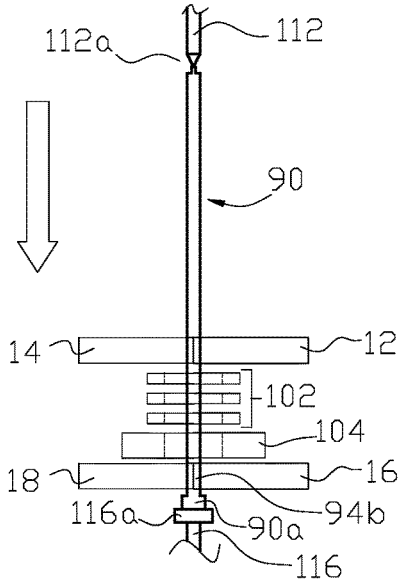
Figure 4B:
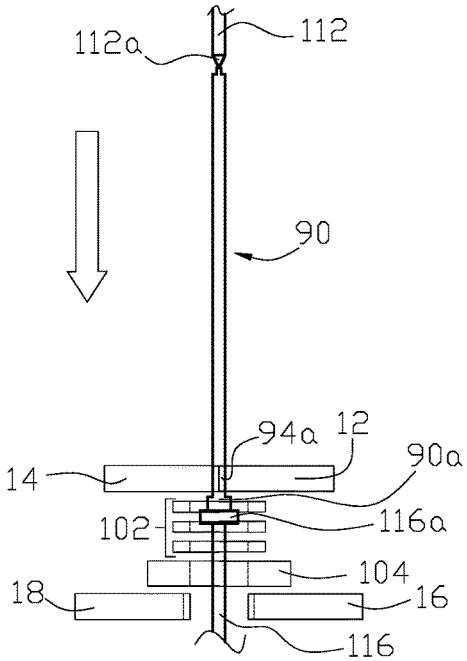
Figure 4D:
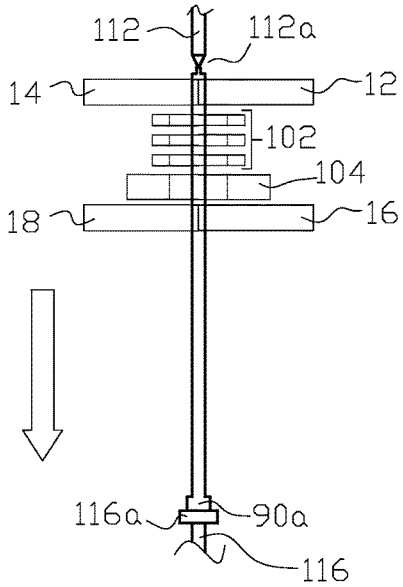
Figure 4E:
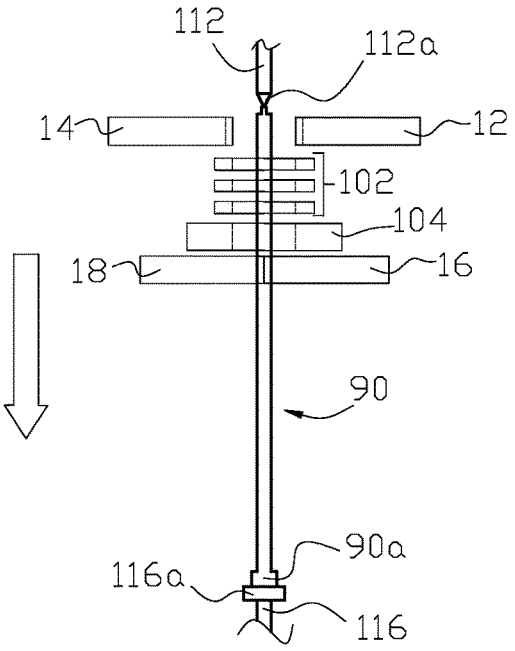
Figure 4G:
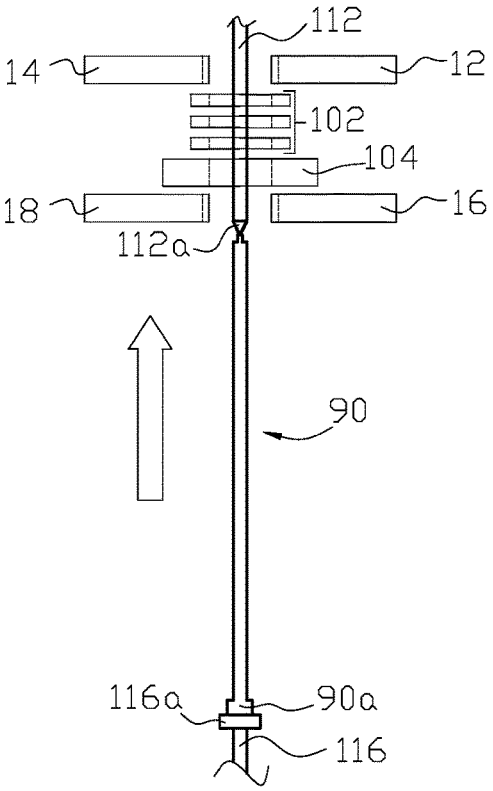
Figure 4F:
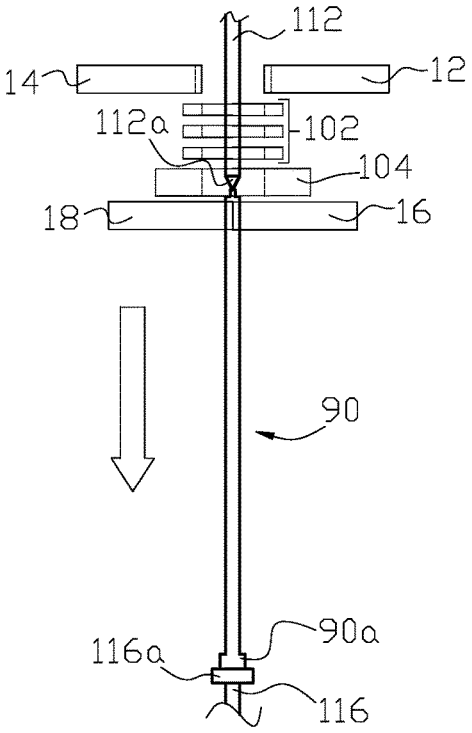

In one non-limiting example of the scan induction heat treatment apparatus of the present invention, as illustrated in FIG. 2(*a*), first opposing pair of workpiece positioning jaws 12 and 14 are suitably positioned above one or more scan inductors 102, and second opposing pair of workpiece positioning jaws 16 and 18 are suitably positioned below quench barrel 104. If quenching apparatus is not used, the second opposing pair of jaws 16 and 18 is suitably positioned below the one or more scan inductors. Each opposing pair of workpiece positioning jaws, or retaining elements, are suitably attached to a separate actuator, or a single dual actuator, such as gripper device 20, which is capable of moving each opposing pair of workpiece positioning jaws between "opened jaws" and "closed jaws" positions as shown in FIG. 3(*b*) and FIG. 3(*a*) respectively. A suitable, but non-limiting, two finger, parallel gripper device is available from Schunk GmbH & Co. KG (Lauffen/Neckar, GERMANY).

Each workpiece positioning jaw, for example, jaw 12, preferably comprises fixed element 12*a* and interchangeable element 12*b* that is removably fitted to the fixed element and secured in position, for example, by one or more removable screws 92 recessed in the fixed and interchangeable elements, or other suitable fasteners. One edge of each jaw, for example, for jaw 12, the edge comprising edge sections 12*a*' and 12*b*' (FIG. 3(*b*)), is referred to as an opposing, or facing, edge of the jaw. In the closed position (FIG. 3(*a*)) opposing edges of a pair of opposing jaws are in contact with each other so that workpiece 90, or center tooling element 112 or 116, passes through an opening formed by semi-openings in a pair of opposing closed jaws. The opening or passage formed by the semi-opening in the pair of opposing closed jaws is of sufficient length (based upon the thickness of the jaws) to provide a vertical constraint of the workpiece. For example, semi-openings 12*b*" and 14*b*" (FIG. 3(*b*)) form opening 94*a* (FIG. 3(*a*)) through which the smaller cross sectional diameter section of the workpiece must pass. In the open position (FIG. 3(*b*)), opposing edges of each one of a pair of opposing jaws are separated from each other so that any section of the workpiece having a cross sectional diameter greater than the diameter of opening 94*a* can freely pass between the opened opposing pair of jaws.

Figure 1:
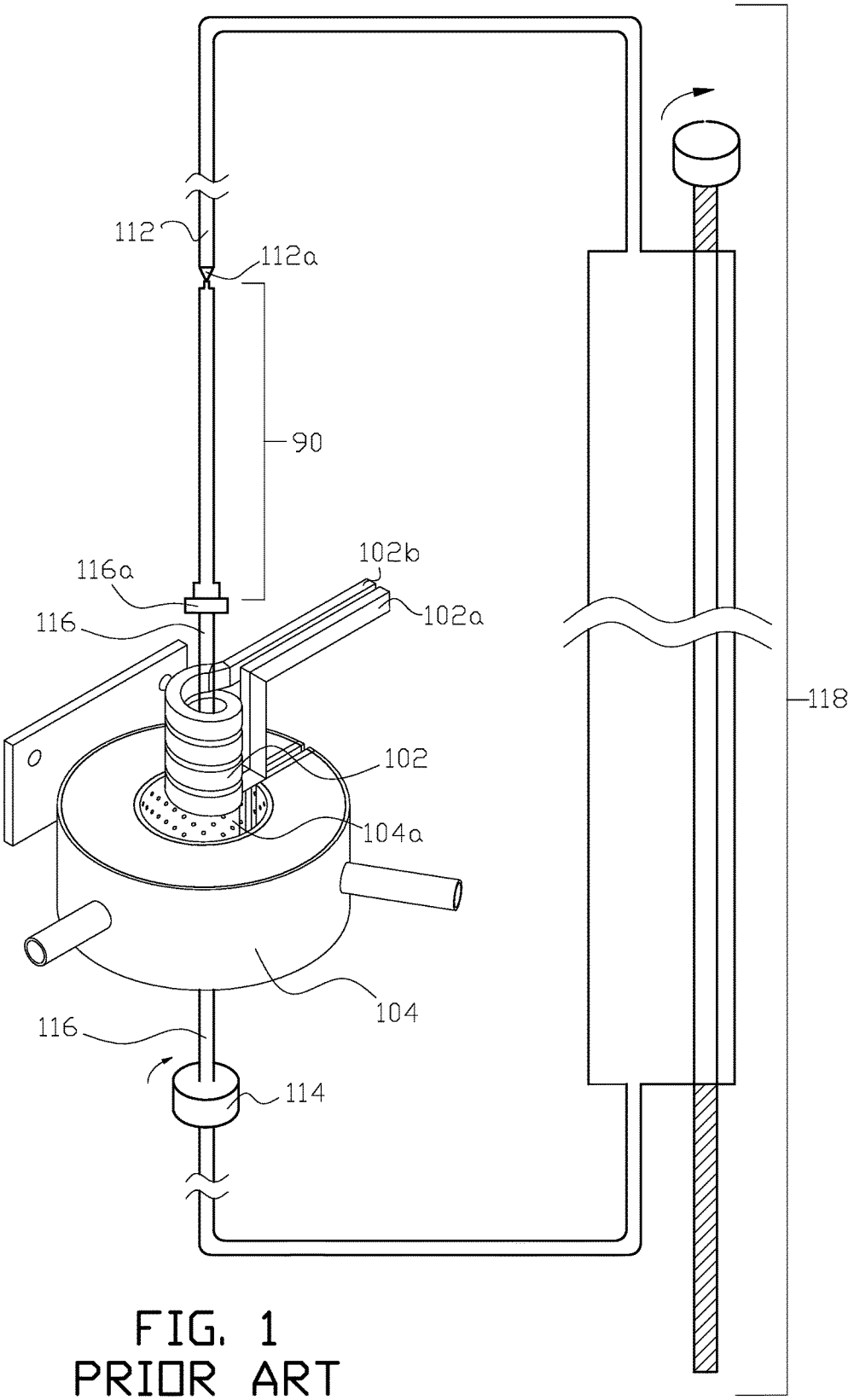
FIG. 1 PRIOR ART
FIG. 1 is a simplified diagrammatic arrangement of a prior art scan induction heat treatment apparatus.

Workpiece 90 in FIG. 2(*a*), FIG. 3(*a*) and FIG. 3(*b*) is held in position between upper center tooling element 112*a* and lower center tooling element 116*a*, with the remainder of the scan induction apparatus being as shown, for example, in FIG. 1. In this particular non-limiting example, workpiece 90 is configured as a socket wrench extension with its lower end 90*a* comprising a socket opening that has a larger (expanded) cross sectional diameter than that of the (non-expanded) remainder of the workpiece. In other examples of the invention, there may be one or more expanded cross sectional regions discreetly located along the length of the elongated workpiece as opposed to its end.

FIG. 4(*a*) through FIG. 4(*h*) illustrate one example of the scan induction heat treatment process of the present invention. Workpiece 90, which is to be heat treated in this example is representative of a workpiece that has an end section 90*a* with a cross sectional diameter greater than the cross sectional diameter of the remainder of the shaft of the workpiece. Workpiece 90 is representative of a socket wrench extension with the open socket end represented by end section 90*a*.

Initially workpiece 90 is positioned above opened upper (entry) and lower (exit) pairs of opposing jaws, scan inductor 102 and quench barrel 104 as shown in FIG. 4(*a*). The scan inductor, and quench barrel, if used, may be referred to as a scan induction apparatus. The mechanical system of the scan induction apparatus begins to move the workpiece downward. When end section 90*a* passes through opened upper opposing pair of jaws 12 and 14, the upper opposing pair of jaws close around the shaft of the workpiece so that the shaft passes through opening 94*a* formed by the closed pair of upper opposing pair of jaws. The workpiece proceeds downward through scan inductor 102 and quench barrel 104 until end section 90*a* passes through opened lower pair of opposing jaws 16 and 18, at which time, the lower opposing pair of jaws close around the shaft of the workpiece so that the shaft passes through opening 94*b* formed by the closed pair of lower opposing pair of jaws as illustrated in FIG. 4(*c*). The workpiece continues to proceed downward through scan inductor 102 and quench barrel 104 until the top end of the workpiece, which is supported by upper center tooling element 112*a* approaches the closed pair of upper opposing jaws as shown in FIG. 4(*d*), at which time, if necessary for clearance of the upper center tooling element 112*a*, the upper opposing pair of jaws will open to allow passage of the upper center tooling element 112*a* between open jaws 12 and 14 as shown in FIG. 4(*e*). After the upper center tooling element has passed the opened upper pair of jaws, the upper pair of jaws can remain open since there is no need to clamp around the upper support element as the remainder of the workpiece proceeds downward through the scan inductor and quench barrel. When upper center tooling element 112*a* approaches the closed pair of lower opposing jaws, if necessary, the lower opposing pair of jaws can open to allow downward passage of the upper center tooling element so that quenching of the end of the workpiece can be accomplished. At this time in the process, the entire length of workpiece 90 has been heat treated. Consequently both the upper and lower pair of opposing jaws can be moved to the open position and the mechanical system of the scan induction apparatus can begin to move the workpiece upward as shown in FIG. 4(*g*) and return the workpiece to its original position shown in FIG. 4(*a*).

A control system can be provided for opening and closing the upper and lower opposing pair of jaws, for example, as described above. For example the actuators associated with opposing jaws may transition the opposing jaws between the opened and closed positions based upon position feedback from linear driver 118.

If workpiece tempering is desired, the above process can be repeated either with the upper and lower opposing pair of jaws fixed in the open position, or cycled between open and closed positions as described above for the quench hardening process.

If tempering is not desired, or after the tempering process has been completed, the heat treated workpiece can be removed from the scan induction apparatus and the next workpiece to be heat treated can be inserted in its place.

Generally the diameters of the openings 94*a* and 94*b* in the closed pair of upper and lower pair of opposing jaws are slightly larger than the cross sectional diameter of the shaft passing through the opening to address design tolerance for the shaft diameter and/or minor vertical skewing of the workpiece as it moves through the openings. This avoids jamming the shaft in a closed opening. For example, for a shaft with a nominal cross sectional diameter in the range of 0.3-inch to 0.8-inch, an additional 0.030-inch can be added to the diameter of the openings. In alternative examples of the invention, the inner surface of each semi-opening in a jaw may be coated with a low friction, heat resistant material, such as a sialon, to promote free movement of the shaft through the opening in a closed pair of opposing jaws.

With the above arrangement, longitudinal deformation of the workpiece is minimized since the upper and lower pairs of opposing jaws are both in the closed position for a substantial portion of quench hardening of the entire length of the workpiece; that is, between process time illustrated in FIG. 4(*c*) and FIG. 4(*d*). The double vertical constraints of the workpiece provided by the openings in the closed upper and lower pair of opposing jaws minimizes any tendency for warping during the quench hardening process.

A suitable, but non-limiting, material for the fixed element of each jaw is an aluminum block. A suitable, but non-limiting, material for the interchangeable element of each jaw is a bronze block. Although the fixed and interchangeable elements are of a rectangular box design in the present example of the invention, the shape of either, or both, elements may change in other examples of the invention. Although openings 94*a* and 94*b* are substantially circular in the present example, the shape of the openings and corresponding semi-openings in other examples may be of different shapes to suit a particular workpiece. An advantage of using a separate interchangeable element is that a plurality of pairs of interchangeable elements, each with a different shape of semi-openings, can be used to quickly change the configuration of the openings 94*a* and 94*b* for various workpieces with different cross sectional dimensions. If only a fixed dimension is required for openings 94*a* and 94*b*, each jaw may be formed from a singular element.

Terms of orientation, such as upper and lower, are used for convenience only and do not limit the apparatus and method of the present invention in terms of orientation of elements of the invention.

The present invention may be embodied in other specific forms without departing from the spirit or essential attributes thereof and, accordingly, reference should be made to the appended claims, rather than to the foregoing specification, as indicating the scope of the invention. The above examples of the invention have been provided merely for the purpose of explanation, and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification, may effect numerous modifications thereto, and changes may be made without departing from the scope of the invention in its aspects.

The invention claimed is:

1. A workpiece support apparatus for retaining an elongated workpiece during an electric induction heat treatment longitudinal scan of the elongated workpiece, the elongated workpiece having at least one expanded cross sectional feature with an expanded cross section greater than a non-expanded cross section of the remainder of the elongated workpiece, the workpiece support apparatus comprising:

a first and second retaining element disposed on opposing sides of an at least one scan induction apparatus, each of the first and second retaining elements comprising a pair of opposing jaws, each of the pair of opposing jaws attached to an actuator for selectively moving the pair of opposing jaws between an opened and a closed position, the closed position forming a closed elongated workpiece longitudinal passage between the pair of opposing jaws, the center of the closed elongated workpiece longitudinal passage axially aligned with an interior passage formed by the at least one scan induction apparatus, the closed elongated workpiece longitudinal passage sized to the non-expanded cross section of the elongated workpiece, the opened position forming an opened elongated workpiece longitudinal passage between the pair of opposing jaws sized to allow free longitudinal passage of the at least one expanded cross sectional feature of the elongated workpiece through the opened elongated workpiece longitudinal passage; and a fixturing apparatus for retaining the opposing ends of the elongated workpiece and for moving the elongated workpiece through the first and second retaining elements and the at least one scan induction apparatus.

2. The workpiece support apparatus of claim 1 further comprising a control system to move the first or second retaining element from the closed position to the opened position when the at least one expanded cross sectional feature approaches the first or second retaining element during the electric induction heat treatment longitudinal scan, and to move the first or second retaining element from the opened position to the closed position when the at least one expanded cross sectional feature exits the first or second retaining element during the electric induction heat treatment longitudinal scan.

3. The workpiece support apparatus of claim 1 where each one of the pair of opposing jaws comprises a rectangular block having a semi-opening in an edge facing a corresponding edge in the opposing jaw, the pair of semi-openings of the pair of opposing jaws forming the closed elongated workpiece longitudinal passage.

4. The workpiece support apparatus of claim 1 where each one of the pair of opposing jaws comprises a rectangular block having a fixed element and an interchangeable element, the interchangeable element having a semi-opening in an edge facing a corresponding edge of an interchangeable element in the opposing jaw, the pair of semi-openings of the pair of opposing jaws forming the closed elongated workpiece longitudinal passage.

5. A method of controlling longitudinal deformation of an elongated workpiece during an electric induction heat treatment longitudinal scan of the elongated workpiece, the elongated workpiece having at least one expanded longitudinal cross sectional feature with an expanded cross section greater than a non-expanded cross sectional length of the remainder of the elongated workpiece, the method comprising the steps of:

positioning a first and second retaining elements on opposing sides of at least one scan induction apparatus having an interior passage for longitudinal passage of the elongated workpiece;

linearly moving the length of the elongated workpiece through the first and second retaining elements and the at least one scan induction apparatus;

retaining the non-expanded cross sectional length of the elongated workpiece as it moves linearly through a closed position opening in the first or second retaining element, the closed position opening sized to the non-expanded cross section of the elongated workpiece; and opening the closed position opening in the first or second retaining element to allow free passage of the at least one expanded longitudinal cross sectional feature of the elongated workpiece during the electric induction heat treatment longitudinal scan.

6. A method of controlling longitudinal deformation of a socket wrench extension during an electric induction heat treatment longitudinal scan of the socket wrench extension, the method comprising the steps of:

positioning an entry retaining element and an exit retaining element on opposing sides of at least one scan induction apparatus having an interior passage for longitudinal passage of the socket wrench extension during the electric induction heat treatment longitudinal scan, each of the entry and exit retaining elements comprising a pair of opposing jaws and an actuator attached to each one of the opposing jaws;

moving the socket wrench extension sequentially through the entry retaining element, the at least one scan induction apparatus and the exit retaining element;

retaining the shaft of the socket wrench extension as it moves linearly through a closed position opening in the first or second retaining element, the closed position opening sized to the cross section of the shaft of the socket wrench extension; and opening the entry or exit retaining element to allow passage of the expanded cross section female end of the socket wrench extension during the electric induction heat treatment longitudinal scan.

* * * * *